US005909768A

United States Patent [19]

Castille et al.

[11] Patent Number: 5,909,768

[45] Date of Patent: Jun. 8, 1999

[54] APPARATUS AND METHOD FOR IMPROVED TUBULAR GRIP ASSURANCE

[75] Inventors: Dale J. Castille; Michael Webre; Donald Mosing, all of Lafayette, La.

[73] Assignee: Frank's Casing Crews and Rental Tools, Inc., Lafayette, La.

[21] Appl. No.: 09/071,999

[22] Filed: May 2, 1998

Related U.S. Application Data

[63] Continuation of application No. 08/783,933, Jan. 17, 1997.

[51] Int. Cl.[6] ..... E21B 7/20

[52] U.S. Cl. ..... 166/77.1; 166/77.4; 166/77.53

[58] Field of Search ..... 166/77.1, 77.4, 166/77.51, 77.52, 77.53

[56] References Cited

U.S. PATENT DOCUMENTS 4,128,888 12/1978 Sheldon et al. ..... 364/565

4,531,875 7/1985 Krueger ..... 414/22

4,621,974 11/1986 Krueger ..... 414/786

5,791,410 8/1998 Castille et al. ..... 166/77.1

*Primary Examiner*—William Neuder

*Attorney, Agent, or Firm*—Matthews, Joseph, Shaddox & Mason, P.L.L.C.; Matthew E. Burr

[57] ABSTRACT

An apparatus for optionally gripping and releasing a tube, said apparatus having an elevator with a set of slips for optionally gripping and releasing a tube and a spider with a set of slips for optionally gripping and releasing the other end of said tube, said elevator and spider slips being in communication one to the other by pressurized conduits, said conduits forming a pressure circuit to supply pressure to release one set of slips only when the other set of slips is gripping said tube, wherein said apparatus has improved response time, said spider may be hydraulically or pneumatically actuated and said elevator maybe pneumatically operated, and wherein said spider may be flush mounted; and methods.

8 Claims, 6 Drawing Sheets

APPARATUS AND METHOD FOR IMPROVED TUBULAR GRIP ASSURANCE

This application is a con of Ser. No. 08/783,933 filed Jan. 1, 1997.

FIELD OF THE INVENTION

This invention relates generally to methods and apparatus for installing and removing well bore pipe, and more particularly pertains to a pressure interlock system with improved response time wherein the elevator slips are pneumatically actuated and the spider slips may be pneumatically or hydraulically actuated, and wherein the spider may be flush mounted.

BACKGROUND OF THE INVENTION

Pneumatic casing tools are gripping devices used to hold and lower tubes or tubular well casing into a pre-drilled hole. The tools are used in sets consisting of one elevator slip assembly and one spider slip assembly. The elevator and spider slip assemblies are functionally identical tools except for the accessories used to operate each tool. A problem associated with the use of these tools is related to gripping the casing collar which is of a larger diameter than the outside diameter of the well casing. The problem is caused when the elevator slip assembly is not lowered sufficiently below the collar. The slip assemblies are designed such that the gripping forces generated are sufficient for proper gripping only when the slips are lowered sufficiently below a casing collar so as to completely grip the outside diameter of the well casing and not the collar. When the collar is gripped, the slips will not sufficiently engage with the casing to generate adequate gripping forces. The result is that partial engagement of the slips against the casing string may result in the casing slipping from the tool and dropping into the well bore causing significant down time and repair.

The person working up in the derrick, called the "stabber", operates the control valves that close the elevator slips. Once the elevator slips are closed and the weight of the casing is on the elevator, the stabber sometimes actuates the control valve to the open direction. However, with the casing weight hanging on the elevator, the air pressure alone will not open the slips. The proper time to actuate the control valve is after the string is lowered and the spider assembly slips are closed, and not before.

There is an instance when this is a problem. This instance would occur when the casing is being lowered into the well bore and meets up with some restriction or abutment which prevents downward movement of the casing. The elevator, however, continues to move downward a short distance because of the reaction time of the driller who is controlling movement of the tool. This situation is a problem when the slips have been actuated in the open direction but have been held down by the weight of the casing. The weight is no longer on the elevator and the slips consequently open up. If the casing should suddenly free itself in this manner and drop, neither the spider nor the elevator are in the closed position and the casing drops into the well bore.

Another problem is that once an elevator or spider has been energized to the open or closed position, there is a time required to allow the tool to reach the gripped position, detect that this has occurred and have the interlock system respond accordingly. During this time the interlock system may not function properly.

Flush mounted spiders utilize a series of hydraulic cylinders rather than pneumatic cylinders to power slips upward to the open position or downward to the closed position. Of particular danger, which is unique to the flush mounted spider, is the ability of the spider slips to be opened inadvertently despite being engaged in the down position with casing suspended in the slips. This is possible due the substantial upward force which can be applied to the slips thus dislodging them from the closed position. The substantial force is the result of the high operating pressures that are typical of hydraulic systems (2000 to 3000 psi) as opposed to the lower operating pressures (80 to 150 psi) that are typical of pneumatically operated elevators and spiders. Additional problems arise due to the fact that the operational controls for this spider are located within a separate control panel as opposed to being mounted on the tool itself.

Pneumatic conduits between the elevator and spider are typically about 120 feet long and ¾ inch in diameter. The fluid volumes from such conduits are large and the response to operation of control valves may be sluggish, possibly endangering the operator. The present invention includes pressure circuits where conduits that would have been ¾ inches in diameter may be about ½ inch in diameter instead, and conduits that would have been 120 feet long are now about three feet long. The smaller conduit lengths and diameters allowed by the present invention reduce the fluid volumes that must be handled by the apparatus. Smaller fluid volumes, in turn, result in improved response time and safer operation of the apparatus.

The pertinent and presently known prior are to this invention are U.S. Pat. Nos. 3,215,203; 3,708,020; 3,722,603; 4,676,312; 4,842,058; and 5,343,962, as well as Varco BJ Oil Tools Brochure entitled FMS 375 Flush Mounted Spider.

OBJECTS TO THE INVENTION

An object of the present invention is an apparatus for gripping and releasing tubes so that one set of tube gripping slips is gripping the tube at all times and that one set of slips may not be released from the tube unless the other set of slips has a firm grip on the well casing.

Another object of the present invention is to deactivate the elevator slips and/or the spider slips against inadvertent actuation unless the other set of slips are fully set in gripping position.

Yet another object of the present invention is an apparatus having enhanced performance of the interlock system by improving the response time.

A further object of the present invention is an apparatus for gripping an releasing a tube wherein at least one set of slips is actuated by hydraulic fluid pressure.

SUMMARY OF THE INVENTION

The above and other objects and advantages are attained in an apparatus for controlling the gripping and releasing of a tube, said apparatus having an elevator with slips for optionally gripping and releasing a tube and a spider with slips for optionally gripping and releasing said tube, said elevator and spider slips being in communication one to the other by a pressure circuit to control the supplying of pressure to release one set of slips only when the other set of slips is gripping the tube. The pressure circuit comprises elevator and spider pressure chambers for actuating the elevator or spider slips to grip or release the tube. The pressure circuit includes a plurality of interconnected elevator valves, spider valves, and conduit systems. The conduit systems comprise multi-position fluid pressure controlling valves to control or regulate the flow of pressure through the circuit and to actuate valves and slips into different positions. The apparatus may also include a drilling rig having a traveling block and a supportive rig floor, a casing gripping fluid actuated casing elevator assembly carried by the traveling block and a casing gripping fluid actuated casing spider assembly mounted on the rig floor. The elevator assembly and the spider assembly each has a piston in a pressurable closing chamber to actuate slips into gripping engagement with well casing when the closing chamber is pressurized, and also a pressurable opening chamber also containing a piston to move the slips into release from the casing when the opening chamber is pressurized. The opening and closing chambers may sometimes be referred to collectively herein as the elevator or spider pressure chamber. The spider may be controlled remotely from said spider. The spider may be a flush mounted spider. One set of slips may be actuated by hydraulic pressure and the other set of slips by pneumatic pressure. The communication and control circuitry of the apparatus may be electrical.

The pressure circuit of the apparatus may include:

(a) an elevator pilot valve connected to said a second elevator valve and to a pressure supply. Said elevator pilot valve is actuated to supply pressure to said first elevator valve only when said spider is in gripping position. Said elevator pilot valve may be a spring offset pilot valve that improves the response time of the apparatus by reducing the volume of fluid pressure that must be vented to atmosphere when operating the apparatus. The conduit connecting the second and pilot elevator valves is only about three feet in length and about one-half of an inch in internal diameter (b) The second elevator valve is connected to said elevator pressure chamber to direct pressure to actuate said elevator slips into gripping or released position. This second elevator valve may be a manually operated control valve that, in one position supplies pressure into said opening chamber of said elevator and venting to atmosphere fluid pressure from said closing chamber of said elevator, and in the other position supplying fluid pressure into said closing chamber of said elevator and venting to atmosphere fluid pressure from said opening chamber of said elevator (c) a third elevator valve actuatably linked to said spider and connected to a pressure supply and to said elevator pilot valve. Said third elevator valve is a slip-position sensing valve actuated into position to supply fluid pressure to actuate said second elevator valve only when said spider is fully gripping. The conduit connecting the third and the second elevator valves is about 120 feet in length, but is only about one-quarter of an inch in diameter, (d) a spider pilot valve connected to a second spider valve and to a pressure supply, said spider pilot valve being actuated to supply pressure to said second spider valve only when said elevator is in gripping position. Said spider pilot valve is a pilot valve substantially the same functionally as the second elevator valve. The conduit connecting the pilot and second spider valves is only about three feet in length and about one-half of an inch in internal diameter;

(e) the second spider valve is connected to spider pilot valve and to said spider pressure chamber to direct said pressure to actuate said spider into gripping or released position. Said second spider valve is functionally substantially the same as the second elevator valve; and, (f) a third spider valve mounted with said elevator and connected to a pressure supply and to said spider pilot valve, said third spider valve is a slip-position sensing valve actuated to supply pressure to actuate said second spider valve only when said elevator is fully gripping. The conduit connecting the third and second spider valves is about 120 feet in length, but only about one-quarter of an inch in internal diameter.

The pressure circuit may also include an additional elevator valve and an additional spider valve each of which can be used to optionally open and close one set of slips regardless of the position of the other set of slips. These valves are manual bypass valves that are ordinarily are always in position to supply pressure through the circuit as the interlock valves direct, but may be manually actuated to switch to a direct pressure supply to override the usual operation of the interlock circuit. The elevator bypass valve may be connected between the second and third elevator valves, and the spider bypass valve may be connected between the second and third spider valves.

The apparatus may also include a flush mounted spider assembly where the spider slips position is sensed directly. The apparatus with a flush mounted spider includes an elevator assembly substantially the same as previously described and a flush mounted spider with a spider control console connected remotely to said spider including:

(a) a first pressure supply connected to an elevator pilot valve and to a spider pilot valve;

(b) a second elevator valve connected to said elevator pilot valve and to said elevator pressure chamber to supply pressure to actuate said elevator slips to grip or release said tubular member;

(c) a second spider valve actuatably linked to said elevator slips, said second spider valve connected to said first pressure supply and to said spider pilot valve to supply pressure from said first supply to said spider pilot valve only when said elevator slips are in the gripping position;

(d) a third spider valve connected to said spider pilot valve and to a fourth spider valve to optionally supply or block pressure from said first supply to said fourth spider valve;

(e) a fifth spider valve connected to said fourth spider valve, to a second pressure supply, to said spider pressure chamber, and connected to said spider pressure chamber to actuate said spider slips to release said tubular member; and a third elevator valve actuatably linked to said spider slips, said third elevator valve connected to said first supply and to said elevator pilot valve to supply pressure from said first supply to said elevator pilot valve only when said spider slips are in the gripping position.

The fifth spider valve may be connected to a different pressure supply than that to which the second elevator valve is connected. The fifth spider valve may be connected to an hydraulic pressure supply, for example, while the second elevator valve is connected to a pneumatic pressure supply. The second elevator and spider valves may be pilot valves that allow narrow conduit diameters and short conduit lengths, as described above, resulting in small fluid volumes to supply the circuit or to vent to atmosphere. Small fluid volume provides quick response time and enhanced operation of the apparatus.

In the preferred embodiment of the apparatus, the elevator slips are controlled pneumatically and the spider slips are actuated hydraulically and remotely from the spider assembly and the spider slip position is sensed in the spider hydraulics, the pressure circuit includes:

(a) a first pressure supply connected to an elevator pilot valve and to a spider pilot valve;

(b) a second elevator valve connected to said elevator pilot valve and to said elevator pressure chamber to supply pressure to actuate said elevator slips to grip or release said tubular member;

(c) a second spider valve actuatably linked to said elevator slips, said second spider valve connected to said first pressure supply and to said spider pilot valve to supply pressure from said first supply to said spider pilot valve only when said elevator slips are in the gripping position;

(d) a third spider valve connected to said spider pilot valve and to a fourth spider valve to optionally supply or block pressure from said first supply to said fourth spider valve;

(e) a fifth spider valve connected to said fourth spider valve, to a second pressure supply, to said spider pressure chamber, and to a sixth and seventh spider valves to actuate said spider slips to release said tubular member;

(g) an eighth spider valve connected to said fifth spider valve to supply pressure to actuate a ninth spider valve; and, (h) said ninth spider valve connected to said first pressure supply to actuate said elevator pilot valve.

The preferred embodiment also includes an additional spider valve and an additional elevator valve connected to said pressure circuit to optionally open and close one set of slips regardless of the position of the other set of slips.

The invention also includes a method for controlling the gripping and releasing of a tube with an apparatus as described above for a conventional pneumatically operated spider, the steps including:

(a) supplying pressure from a pressure supply connected to an elevator pilot valve and to a spider pilot valve;

(b) supplying pressure to a second elevator valve connected to said elevator pilot valve and to said elevator pressure chamber to supply pressure to actuate said elevator slips to grip or release said tubular member;

(c) supplying pressure to a second spider valve actuatably linked to said elevator slips, and said second spider valve connected to said first pressure supply and connected to said spider pilot valve to supply pressure from said first supply to said spider pilot valve only when said elevator slips are in the gripping position;

(d) supplying pressure to a third spider valve connected to said spider pilot valve connected to said spider pilot valve and to said spider pressure chamber to supply pressure to actuate said spider slips to grip or release said tubular member;

supplying pressure to a third elevator valve actuatably linked to said spider slips, said third elevator valve connected to said first pressure supply and to said elevator pilot valve to supply pressure from said first supply to said elevator pilot valve only when said spider slips are in the gripping position.

In another embodiment, the present invention includes a method for optionally controlling the gripping and releasing of a tube with an apparatus as described above where the spider is hydraulically operated and the spider slip position is sensed directly, the steps including:

(a) supplying pressure from a first pressure supply connected to an elevator pilot valve and to a spider pilot valve;

(b) supplying pressure to a second elevator valve connected to said elevator pilot valve and to said elevator pressure chamber to supply pressure to actuate said elevator slips to grip or release said tubular member;

(c) supplying pressure to a second spider valve actuatably linked to said elevator slips, said second spider valve connected to said first pressure supply and to said spider pilot valve to supply pressure from said first supply to said spider pilot valve only when said elevator slips are in the gripping position;

(d) supplying pressure to a third spider valve connected to said spider pilot valve and to a fourth spider valve to optionally supply or block pressure from said first supply to said fourth spider valve;

(e) supplying pressure to a fifth spider valve connected to said fourth spider valve, to a second pressure supply, to said spider pressure chamber, and connected to said spider pressure chamber to actuate said spider slips to release said tubular member; and supplying pressure to a third elevator valve actuatably linked to said spider slips, said third elevator valve connected to said first supply and to said elevator pilot valve to supply pressure from said first supply to said elevator pilot valve only when said spider slips are in the gripping position.

In a preferred embodiment, the present invention includes a method for optionally controlling the gripping and releasing of a tube with an apparatus as described above where the spider slip position is sensed in the spider, the steps including:

supplying pressure from a first pressure supply connected to an elevator pilot valve and to a spider pilot valve;

(b) supplying pressure to a second elevator valve connected to said elevator pilot valve and to said elevator pressure chamber to supply pressure to actuate said elevator slips to grip or release said tubular member;

(c) supplying pressure to a second spider valve actuatably linked to said elevator slips, said second spider valve connected to said first pressure supply and to said spider pilot valve to supply pressure from said first supply to said spider pilot valve only when said elevator slips are in the gripping position;

(d) supplying pressure to a third spider valve connected to said spider pilot valve and to a fourth spider valve to optionally supply or block pressure from said first supply to said fourth spider valve;

(e) supplying pressure to a fifth spider valve connected to said fourth spider valve, to a second pressure supply, to said spider pressure chamber, and to a sixth and seventh spider valves to actuate said spider slips to release said tubular member;

(g) supplying pressure to an eighth spider valve connected to said fifth spider valve to supply pressure to actuate a ninth spider valve; and, (h) supplying pressure to said ninth spider valve connected to said first pressure supply to actuate said elevator pilot valve.

DESCRIPTION OF A PREFERRED EMBODIMENT

For convenience only, please refer to Table 1, provided to suggest some valves and pressure control functions for the following disclosure.

TABLE I

| VALVE DESCRIPTIONS |
|---|
| 58-4-way two position pneumatic directional control valve, manual lever |
| Used to raise and lower slips, only functions if valve #72 has pilot signal |
| 158-4-way two position pneumatic directional control valve, manual lever |
| Used to raise and lower slips, only functions if valve #72 has pilot signal |
| 72-3-way two position pneumatic directional control valve, spring offset, pilot operated |
| Blocks air supply to valve #58 until slips are set on spider, valve #60 actuated |
| 160-3-way two position pneumatic directional control valve, spring offset, cam operated |
| Sends pilot signal to valve #78 when valve #76 is in the interlock position |
| 74-3-way manual ball valve |
| Selects air source, either air supply or pilot from valve #84 |
| 88-3-way two position hydraulic directional control valve, spring offset, hydraulic pilot |
| Sends pilot oil to pilot on valve #84, sending air signal to valve #74 and valve #72 if valve #74 is in interlock position. |
| 84-3-way pneumatic functional control valve, spring offset, hydraulic pilot |
| Sends pilot signal to valve #72 thru valve #74 |
| 86-4-way hydraulic directional control valve, pneumatic pilot |
| Used to raise and lower slips, only functions if valves #80 & #82 are shifted to both up or both down position |
| 82-5-way pneumatic directional control valve, two position, detent |
| Used in conjunction with valve #80 to raise and lower slips |
| 80-5-way pneumatic directional control valve, two position, detent |
| Used in conjunction with valve #82 to raise and lower slips |
| 78-3-way two position pneumatic directional control valve, spring offset, pneumatic pilot |
| Blocks air supply to valves #82 & #80 until slips are set on elevator, valve #160 actuated and valve #76 in the interlock position |
| 76-3-way manual ball valve |
| Selects air source, either air supply or pilot from valve #160 |
| 90-hydraulic selector valve, dual pressure |
| Reduces available pressure to set slips until valve #60 is actuated |
| 60-4-way two position hydraulic directional control valve, cam operated |
| Selects high pressure when slips are set properly on pipe body. |

Figure 1:
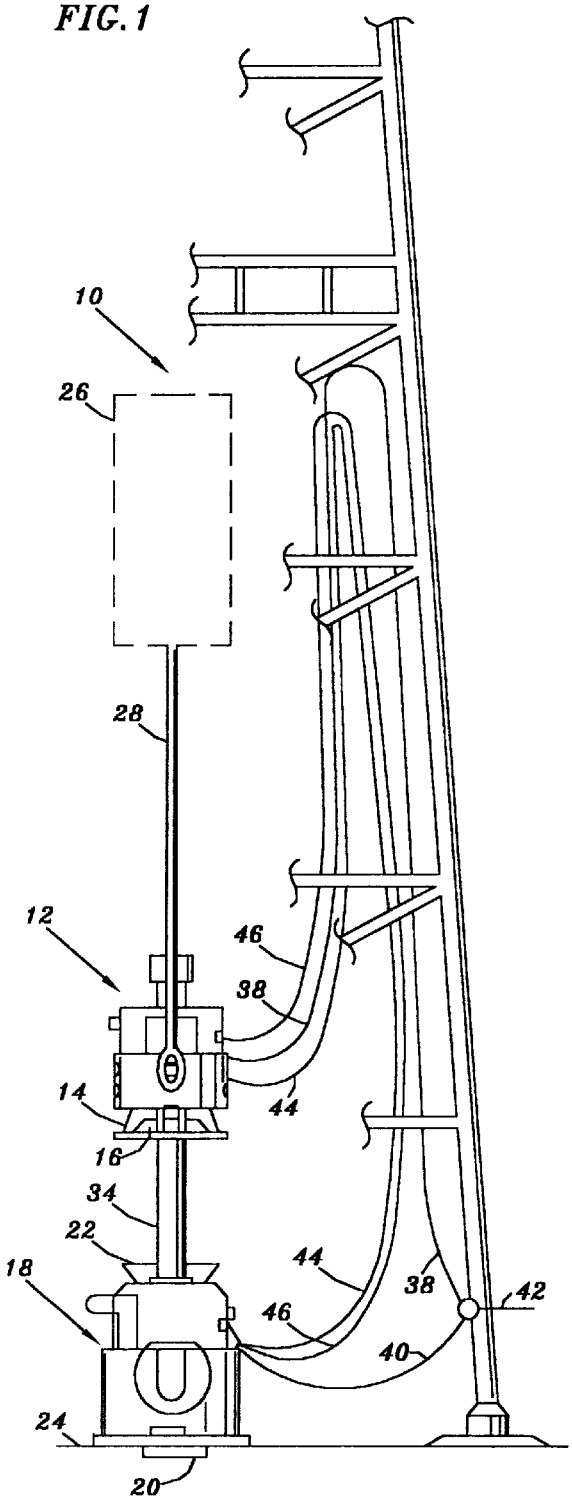
FIG. 1 is a partial elevated view of a drilling rig showing an elevator supported by links from a traveling block and a spider slip assembly supported by the rig floor.

Referring first to FIG. 1, there is shown the pertinent portion of a drilling rig 10 which is rigged to run well casing with an elevator slip assembly 12 suspended from links 28 and a traveling block 26 (indicated in dashed lines), and a spider slip assembly 18 supported on the rig casing guide 16. The spider assembly 18 carries a bottom guide 20, shown in dashed lines, and a spider top guide 22 as shown.

As also shown in FIG. 1, the elevator and the spider are air actuated from an air supply 42 which passes through a conduit or hose 38 to the elevator 12 and through a conduit or hose 40 to the spider 18. Interconnected between the elevator 12 and the spider 18 are conduits or hoses 44A and 46A which have a purpose made more clear with reference to FIG. 4.

Figure 2:
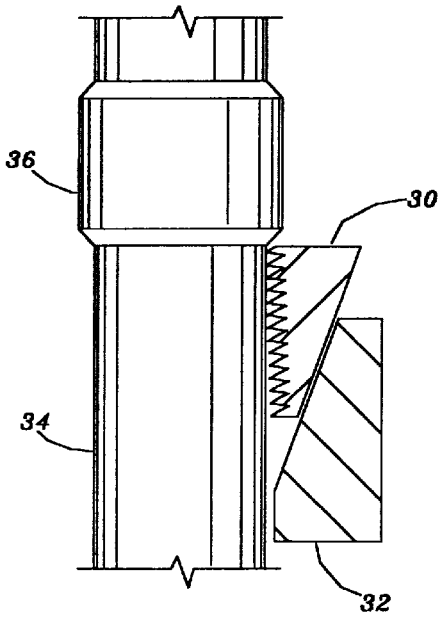
FIG. 2 illustrates the appropriate and proper setting of slips into a bowl to seat about a well casing.

FIG. 2 schematically illustrates a slip member 30 seated in a slip bowl 32 and firmly engaged in gripping contact with well casing 34 just below a casing collar 36. This FIG. 2 illustrates the internal configuration of both the elevator 12 and the spider 18 when the slips 30 are correctly seated.

Figure 3:
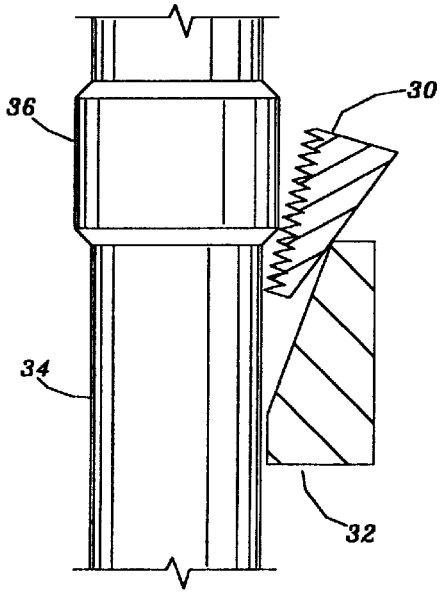
FIG. 3 is an elevational view similar to FIG. 2 but showing the slips incorrectly or improperly seated about the collar of a well casing and not properly seated into the slip bowl.

FIG. 3 schematically illustrates a situation where the slip member 30 has engaged with the casing collar 36, has not been correctly seated in the slip bowl 32, and has not been seated correctly around the casing 34. The "cocking" of the slip 30 is exaggerated but it can be seen that the gripping action of slip member 30 is precarious at best and subject to being dislodged with little "bumping" of the casing against some obstruction in the well bore.

Figure 4:
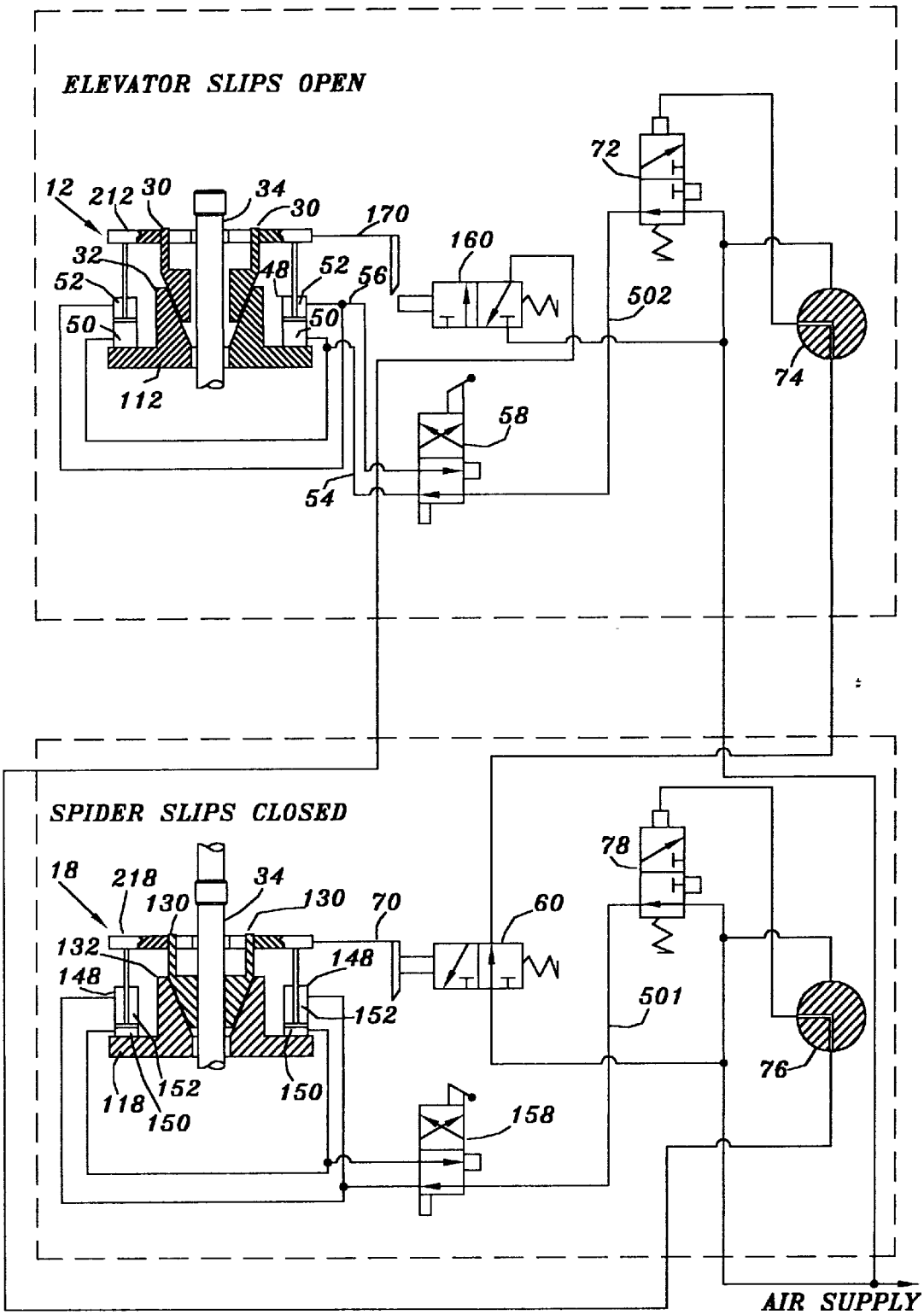
FIG. 4 is a schematic illustration of the elevator slip assembly and the spider slip assembly along with the fluid pressure connections of the operator actuated valves, the pilot valves, and the slip position actuated valves of the present invention.

The elevator slip assembly 12 and the slip spider assembly 18 are illustrated in FIG. 4 purely for functionality and do not reflect the actual internal construction of the elevator 12 and the spider 18 as appearing in FIG. 1. It will be seen that the schematic representation of elevator 12 and spider 18 is similar to corresponding assemblies as shown in U.S. Pat. No. 4,676,312. Though schematic and functional, the elevator 12 and the spider 18 as shown in FIG. 4 accurately correspond to the function of the same elements or parts thereof as shown in FIGS. 1–3.

In FIG. 4 the elevator 12 is to include a plurality of slips 30 adapted to be guided into a slip bowl 32 to be engaged and disengaged from the well casing 34. In this particular view, the slips 30 are pulled up in retracted position so as to be free and clear of the casing 34 and the casing collar 36.

The elevator 12 is equipped with two slip piston cylinder assemblies 48 which form respectively a slip release pressure chamber 50 and a slip closure pressure chamber 52. The slip release chambers 50 are connected through a conduit 54 into a manually actuated two-position slip actuator valve 58. The slip closure chambers 52 are connected through a slip closure conduit or line 56 into also into the two-position valve 58. The valve 58 is adapted to admit fluid pressure into slip release chambers 50 while venting fluid pressure from the slip closure chambers 52 through the line 56 to atmosphere. When the valve 58 is shifted to its second position, fluid pressure is admitted to the slip closure chambers 52 while venting pressure from the release chambers 50 through line 54 to atmosphere.

EXAMPLE I

Operating Sequence for Running Casing or Tubing Air Operated Elevator and Conventional Air Operated Spider The following example will list the steps used when running casing or tubing down hole. (The procedure described below is the same irrespective of whether casing or tubing is being run, therefore for simplicity we will refer to casing when referring to the pipe being run but this is not intended to limit the scope of this procedure to casing applications.)

Start with the spider slips set on the casing and one joint installed above the spider. The elevator is hoisted above the joint which has just been installed above the spider. The elevator slips are in the open position. The control valves are illustrated on FIG. 4.

Step 1

Lower elevator over casing past coupling and set slips by manually shifting valve #58 to down position. Valve #58 is supplied with air through line 502 via valve #72 which is piloted by valve #60 which is physically mounted on the spider. Valve #60 is actuated by the slip lowering/opening mechanism on the spider. Once the spider slips are properly set, or valve #60 is mechanically actuated so as to send a signal to valve #72 opening valve #72 thus permitting flow of air to valve #58 and onward to the rod end of the pneumatic cylinders on the elevator slip close mechanism forcing the slips downward into engagement with the pipe.

Step 2

Once elevator is set, release slips on spider by manually shifting valve #158 on standard air spider to the up position. Valve #158 will have an air source if valve #160 on the elevator has been actuated by the elevator slip close mechanism signaling that the elevator slips have been properly set on the pipe body. The signal from valve #160 pilots valve #78 so as to allow air flow through line #501 to valve #158. If the elevator is not set properly on the pipe, valve #160 will not be shifted and no pilot air will be available to valve #78 making it not possible to open the slips on the spider.

Step 3

Once the spider is open, the string is lowered through the spider until the elevator is just above the spider. The spider slips are set as described in Step 1 and the next joint is lifted into position for make up. Should someone shift the spider valve #158 on the spider before the elevator is in position and slips have been properly set, the spider will not open because valve #160 on the elevator has not been actuated signaling that the elevator slip have been properly set. This would prevent the string of pipe from being dropped down hole.

Figure 5:
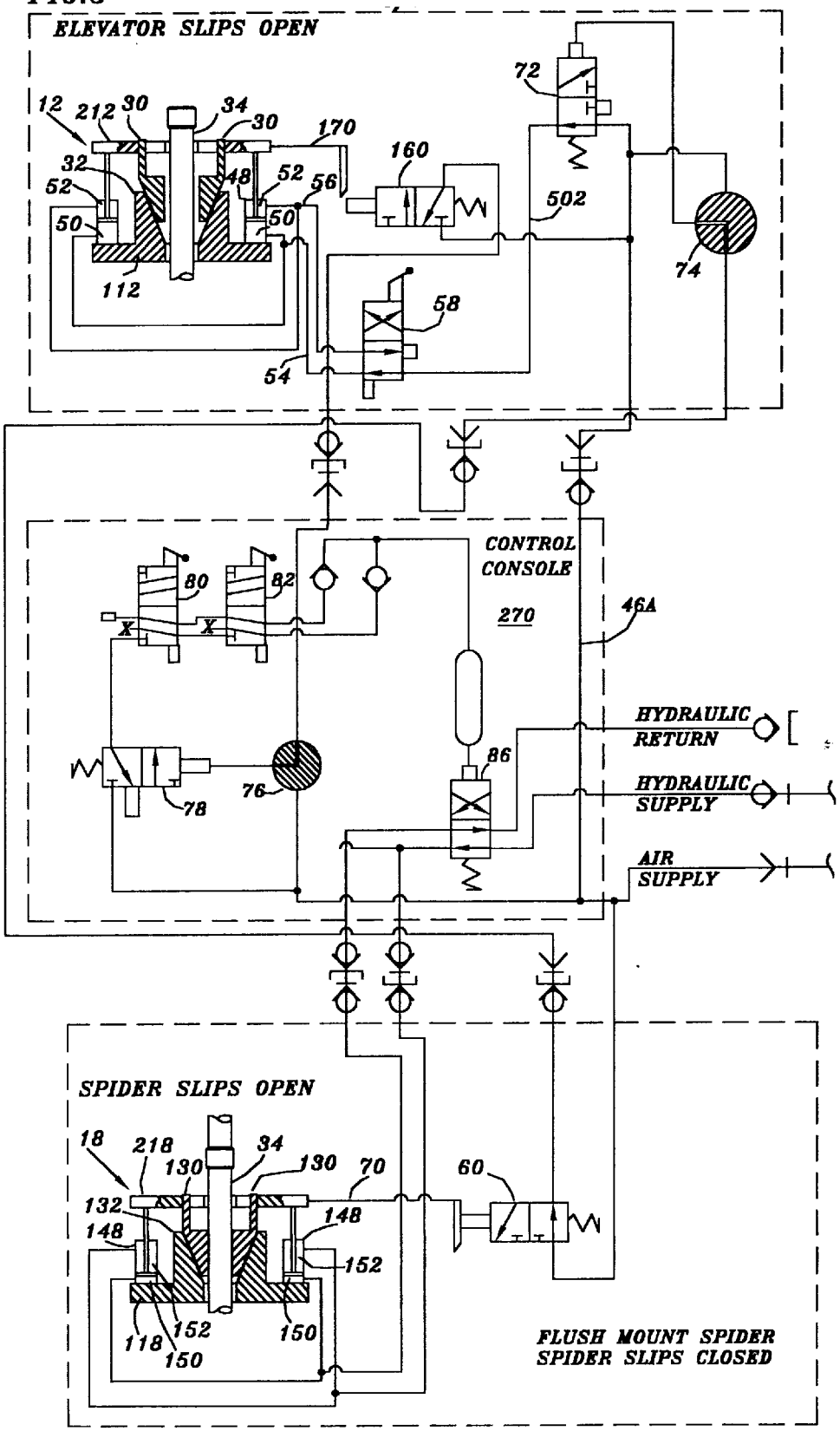
FIG. 5 is a schematic illustration of the elevator slip assembly and the spider slip assembly where the spider is a flush mounted spider and showing the valves and connections for the remote control console and interlock system of the present invention when used with an hydraulically actuated flush mounted spider.
Figure 6:
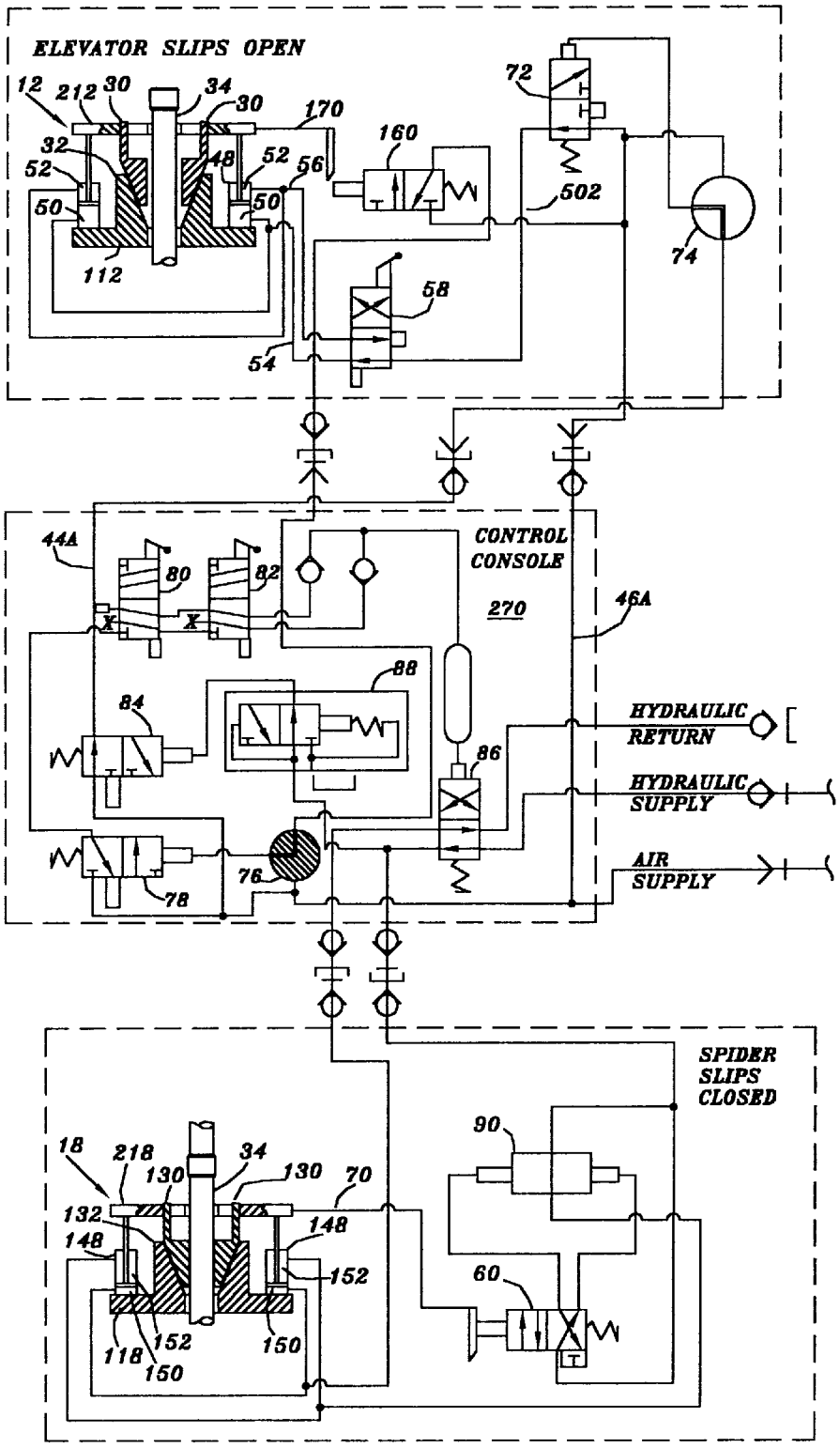
FIG. 6 is a schematic illustration of the valves and connections of a preferred embodiment of the present invention when used with an hydraulically actuated flush mounted spider where the elevator slips are open and the spider slips are closed.

Referring now to FIGS 5, 6, 7, and 8, fluid pressure is admitted into the control valve 58 through a conduit or line 502 from a two-position, spring offset pilot valve 72 which is actuated into position to admit fluid pressure to control valve 58 by fluid pressure admitted through a three-way elevator interlock valve 74 connected to optionally admit fluid pressure either from a direct supply such as compressed air (FIG. 6) through line 46A, or from two-position spider control console valve 84 (FIG. 7) through line 46A. Line 502 may be as short as approximately three feet in length and as narrow as approximately ½ of an inch in diameter, as compared to ¾ of an inch in diameter for typical elevator conduits. Line 44A may be about 120 feet in length, but only approximately ¼ of an inch in diameter as compared to ¾ of an inch as is typical for elevator-spider conduits. Pilot valve 84 is actuated to admit fluid pressure to elevator interlock valve 74 by fluid pressure admitted through a two-position, spring offset, pilot valve 88 which is actuated in turn by fluid pressure passing through pressure selector valve 90. Pressure selector valve 90 admits fluid pressure to spider closing chamber 152 to close the spider, and is actuated by fluid pressure admitted through control valve 60 into position to supply reduced hydraulic pressure to spider slips 30 when the spider 18 is fully closed into gripping position (FIG. 6). Valve 90 is a safety feature of the apparatus. Since hydraulic pressure is significantly greater than pneumatic pressure, valve 90 is useful to moderate the force of the hydraulic pressure on the spider slips. Pilot valve 78 admits fluid pressure from a direct pneumatic fluid pressure source through line or conduit 501 to a manually operated, two-position control console valves 80 and 82 only when the elevator 160 is fully closed into gripping position. Line 501 may be as short as approximately three feet in length and as narrow as approximately ½ inch in diameter. Control console valves 80 and 82 must both be in position to admit fluid pressure to actuate two-position, spring offset pilot valve 86 to admit fluid pressure from a hydraulic source to open and close the spider 18. Pilot valve 78 is actuated through interlock valve 76, only when the elevator 12 is closed, by fluid pressure admitted when elevator slip position sensing valve 160 is actuated into position to admit fluid pressure by the elevator 12 being fully closed into gripping position. Position sensing valve 160 is a two-position, spring offset valve mechanically actuated into position to admit fluid pressure to interlock valve 76 only when the elevator is fully closed into gripping position. If the elevator is in any position other than fully closed into gripping position, valve 160 blocks fluid pressure supply to valve 76 from a direct pneumatic source and vents to atmosphere fluid pressure from the elevator closing chamber 52. Pilot valves 72 and 78 allow for conduits of overall small fluid volume in the apparatus and improved response time.

EXAMPLE 2

Operating Sequence for Running Casing or Tubing Air Operated Elevator and Flush Mount Spider with Direct Position Sensing in Spider The following example will list the steps used when running casing or tubing down hole. The elevator being used is a conventional air operated type elevator and the spider is a Flush Mount Type Spider powered by hydraulics. The spider hydraulic control valves are located within a separate control console. The spider interlock function is accomplished by the use of a pneumatic slip position sensing valve which is mounted in the spider apparatus itself. (The procedure described below is the same irrespective of whether casing or tubing is being run, therefore for simplicity we will refer to casing when referring to the pipe being run but this is not intended to limit the scope of this procedure to casing applications.)

Start with the spider slips set on the casing and one joint installed above the spider. The elevator is hoisted above the joint which has just been installed above the spider. The elevator slips are in the open position. The control valves are illustrated on FIG. 5.

Step 1

Lower elevator over casing past coupling and set slips by manually shifting valve #58 to down position. Valve #58 is supplied with air through line 502 via valve #72 which is piloted by valve #60 which is physically mounted on the spider. Valve #60 is actuated by the slip lowering/opening mechanism on the spider. Once the spider slips are properly set, or valve #60 is mechanically actuated so as to send a signal to valve #72 opening valve #72 thus permitting flow of air to valve #58 an onward to the rod end of the pneumatic cylinders on the elevator slip close mechanism forcing the slips downward into engagement with the pipe.

Step 2

Once elevator is set, release slips on spider by manually shifting valve #'s 80 and 82 on the spider control panel to the up position. Valves #'s 80 and 82 are supplied with air via valve #78 and valve #78 is piloted to supply air if valve #160 on the elevator has been actuated by the elevator slip close mechanism signaling that the elevator slips have been properly set on the pipe body. If the elevator is not set properly on the pipe, valve #160 will not be shifted and no pilot air will be available to valve #78 making it not possible to open the slips on the spider.

Step 3

Once the spider is open the pipe string is lowered through the spider until the elevator is just above the spider. The spider slips are set as described in Step 1 and the next joint is lifted into position for make up. Should someone shift the valves #'s 80 and 82 on the spider control console before the elevator is in position and slips have been properly set, the spider will not open because valve #160 on the elevator has not been actuated signaling that the elevator slips have been properly set. This would prevent the string of pipe from being dropped down hole.

OPERATION OF THE PREFERRED EMBODIMENT

Now referring to FIGS. 4, 6, 7, 8 in view of FIGS. 1 and 2, the spider 18 is set on the rig floor and the elevator 12 is suspended from the traveling block 26 and links 28 as shown. In operation, the casing string 34 is suspended into the hole from elevator 12 and lowered by the traveling block 26. During this time the slips in the spider 18 are opened and the pipe 34 travels freely through it The slips of the elevator are closed and firmly grip casing 34.

When the casing string 34 is lowered to where there is no gap between the elevator 12 and the spider 18, the slips on the spider 18 are closed (FIG. 7) by actuating spider control valves 80 and 82 together, thus allowing the casing 34 to be suspended from the spider. Spider control valves 80 and 82 are connected to spider 18 remotely, allowing the operator to control the spider slips from a safe distance. To inhibit inadvertent opening of the slips, both of valves 80 and 82 must be actuated to open the slips 130 of spider 18 into released position. The slips 30 in the elevator 12 are opened by actuating elevator control valve 58 to supply pneumatic pressure to elevator opening chamber 50. The traveling block 26 is lifted with the attached elevator 12. Another single joint of casing 34 is screwed into the top of the casing string 34.

Once the casing joint is screwed into place, the elevator 12 is lowered over the casing to a point below the collar at the top of that last joint. The elevator slips 30 are then closed by actuating elevator control 58 to supply pneumatic pressure to elevator closing chamber 52 and the elevator is used to lift the casing 34 a very short distance. This short lift is to enable the slips 130 and the spider 18 to be opened. Now the casing string 34 is again suspended from the elevator 12, thus allowing the whole string to be lowered to start the sequence again for another single joint of casing.

The gripping system shown in FIGS. 4 through 8 assures that, at all times, one set of the slips 30 or 130 are closed into firm gripping contact with the body of the casing 34. If one set is not closed then the other set will not be able to be energized to be released.

The piloted valve 72 and 78 shown in FIGS. 4 through 8 reduces the volume of compressed fluid that must be released to the atmosphere each time the elevator or spider is operated resulting in improved response time of the gripping assembly.

Spider control console valve 86 is actuated by pneumatic pressure supplied from valve 82 to supply hydraulic pressure from a hydraulic pressure supply to open and close the spider slips 130. Spider valve 88 is actuated by the hydraulic pressure supplied through valve 86 to supply hydraulic pressure to actuate spider control valve 84 to supply pneumatic pressure to elevator pilot valve 72.

It is to be noted that positioning of the interlock valve 60 and 160 by their respective linkages 70 and 170 is critical such that the respective actuating valves 58 and 158 may be actuated only when the other of the respective slips 30 and 130 are closed into firm gripping engagement with the pipe body. Closing either set of slips on a larger diameter such as a collar 36 would not permit the respective position valve 60 or 160 to actuate as described. The system therefore assures that at least one of elevator 12 or spider 18 will be firmly gripping the casing 34 at all times.

PREFERRED EMBODIMENT

Operating Sequence for Running Casing or Tubing Air Operated Elevator and Flush Mount Spider with Pressure Sensing in Spider Hydraulics as a Means of Slip Position Sensing The following example will list the steps used when running casing or tubing down hole. (The procedure described below is the same irrespective of whether casing or tubing is being run, therefore for simplicity we will refer to casing when referring to the pipe being run but this is not intended to limit the scope of this procedure to casing applications.) The elevator being used is a conventional air operated type elevator and the spider is a Flush Mount Type Spider powered by hydraulics. The spider hydraulic control valves are located within a separate control console. The spider interlock function is accomplished by the use of a hydraulic slip position sensing valve #60 which is mounted in the spider apparatus itself. The hydraulic slip position sensing valve regulates the hydraulic cylinder pressure (via control of valve #90) being applied to the rod ends of the spider slip set cylinders. Slip position sensing valve #60 restricts the pressure being applied to the cylinders to a low level of approximately 500 psi until the spider slips are properly set at which time valve #60 is actuated and the pressure being applied to the cylinders is increased to approximately 2000 psi. Valve #88 located in the spider control console monitors this varying pressure and is actuated at 1000 psi to send a signal to valve #84 also located in the console. Therefore, once the spider slips are properly set valve #60 is actuated and the hydraulic pressure rises from the 500 psi set point to 2000 psi resulting in valve #88 being actuated sending a signal to actuate valve #84. Actuation of valve #84 sends a signal via line 44A to valve #72 located on the elevator which in turn supplies air pressure to the inlet of manual valve #58 making it possible to open the elevator slips.

Start with the spider slips set on the casing and one joint installed above the spider. The elevator is hoisted above the joint which has just been installed above the spider. The elevator slips are in the open position. The control valves are illustrated on FIG. 6.

Step 1

Lower elevator over casing past coupling and set slips by manually shifting valve #58 to down position. Valve #58 is supplied with air through line 502 via valve #72 which is piloted by valve #84 which is piloted by valve #88. Valve 88 responds to the changing hydraulic pressure when the spider slips are properly set. When the spider slips are properly set, valve #60 is mechanically actuated increasing the hydraulic system pressure from 500 psi to 2000 psi and in accordance with the circuit description above results in valve #72 on the elevator being actuated thus permitting flow of air to valve #58 and onward to the rod end of the pneumatic cylinders on the elevator slip close mechanism forcing the slips downward into engagement with the pipe. The control valves are now illustrated in FIG. 8.

Step 2

Once the elevator is set, release the spider slips by manually shifting valves #80 and #82 on the spider control console to the up position. Valves #'s 80 and 82 are supplied with air via valve #78 and valve #78 is piloted to supply air if valve #160 on the elevator has been actuated by the elevator slip close mechanism signaling that the elevator slips have been properly set on the pipe body. If the elevator is not set properly on the pipe, valve #160 will not be shifted and no pilot air will be available to valve #78 making it not possible to open the slips on the spider. The control valves are now illustrated in FIG. 7.

Step 3

Once the spider is open the pipe string is lowered through the spider until the elevator is just above the spider. The spider slips are set as described in Step 1 and the next joint is lifted into position for make up. Should someone shift the valves #'s 80 and 82 on the spider control console before the elevator is in position and slips have been properly set, the spider will not open because valve #160 on the elevator has not been actuated signaling that the elevator slips have been properly set. This would prevent the string of pipe from being dropped down hole.

Line 44A may be approximately 120 feet in length, but only ¼ of an inch in diameter, as compared with ¾ inch diameters typically used for elevator-spider conduits.

Figure 7:
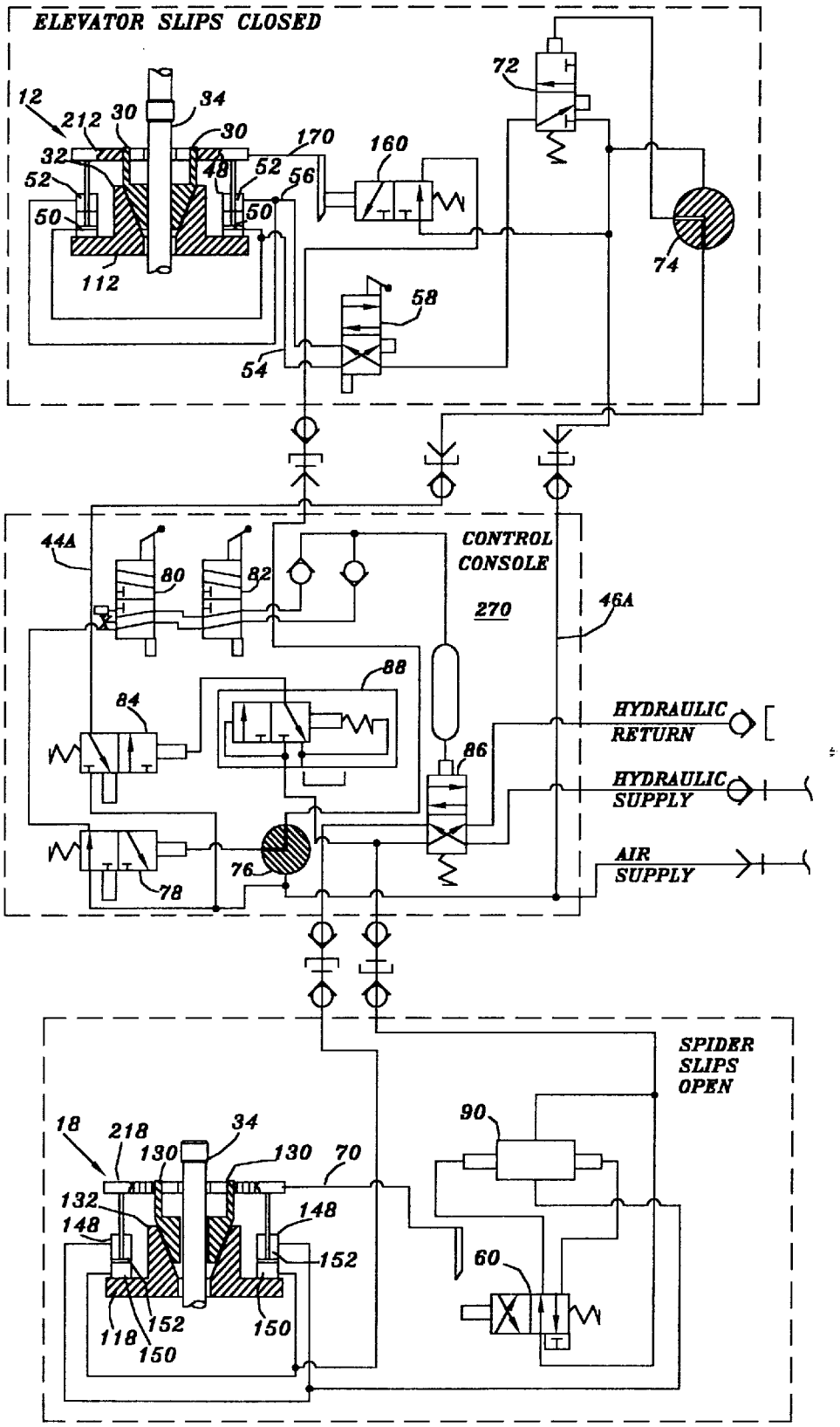
FIG. 7 is a schematic illustration of the valves and connections of a preferred embodiment of the present invention when used with an hydraulically powered flush mount spider where the elevator slips are closed and the spider slips are open.
Figure 8:
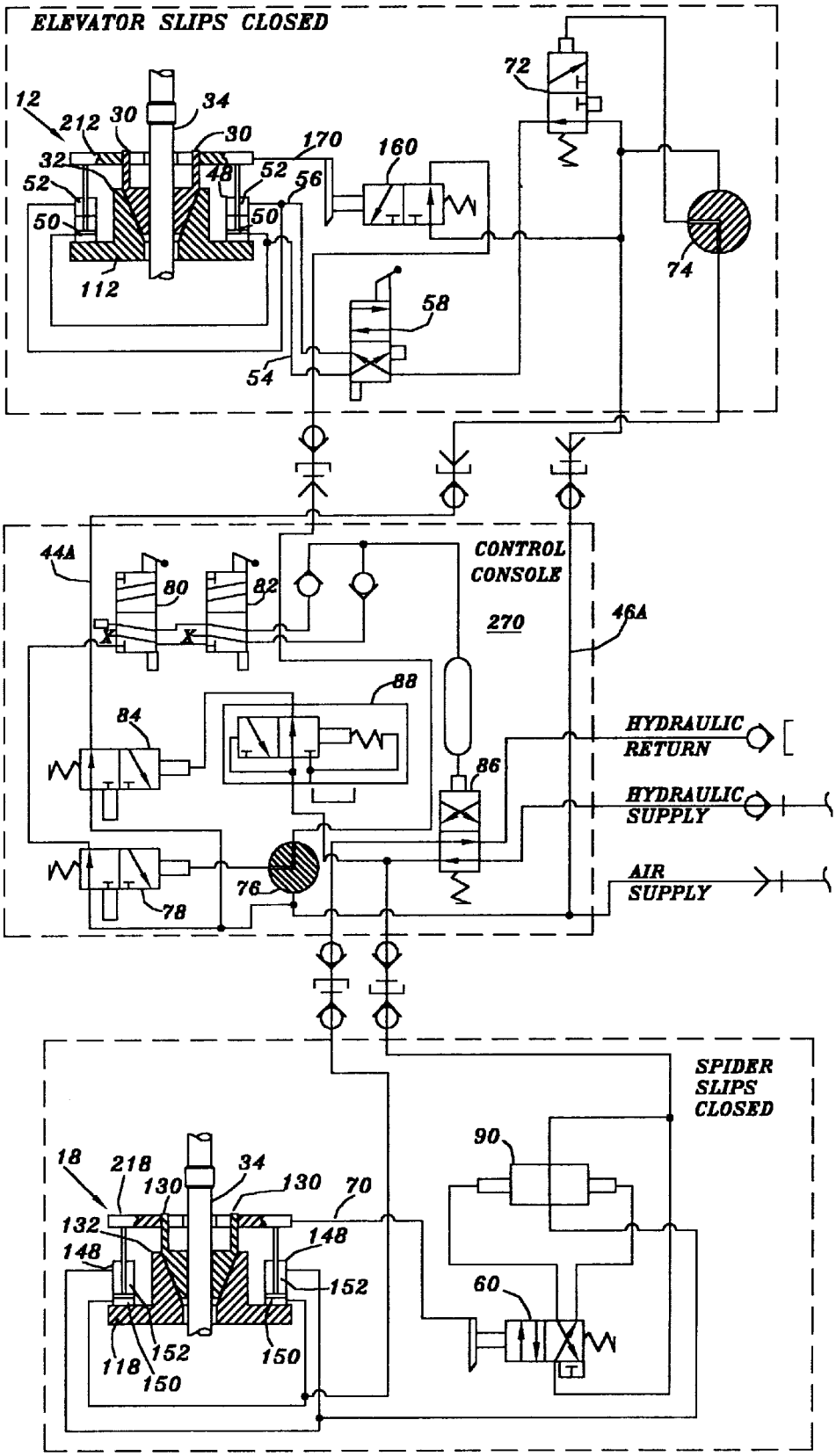
FIG. 8 is a schematic illustration of the valves and connections of a preferred embodiment of the present invention when used with an hydraulically powered flush mount spider where both the elevator and spider slips are closed.

The system described above is one that utilized compressed air to open and close the slips as well as a way of transmitting signals from one tool to the other. It is readily seen that the same interlock system herein described could be used in a hydraulic circuit equally well, providing that various components are designed for hydraulic operation. An hydraulically operated Flush Mount Spider may be utilized with a pneumatically operated elevator and as shown in FIGS. 5, 6, and 7, a control console 270 may be connected remotely to the flush mounted spider 18. It is also readily apparent that the system as herein described could be an electropneumatic system or an electrohydraulic system with the valves disclosed actuated by electrical solenoids connected through appropriate limits switches.

It will be apparent to those skilled in the art that the embodiment herein described may be modified and/or changed with such modifications or changes remaining within the spirit of the invention and the purview and scope of the appended claims.

What is claimed is:

1. An apparatus for controlling the gripping and releasing of a tubular member, the apparatus comprising:

an elevator with a set of slips for optionally gripping and releasing a tubular member;

a spider with a set of slips for optionally gripping and releasing said tubular member; and a pressure circuit in communication with said elevator slips and said spider slips, wherein said pressure circuit controls the supply of pressure to release one set of slips only when the other set of slips is gripping said tubular member.

2. The apparatus of claim 1, wherein said spider is a flush mounted spider.

3. The apparatus of claim 1, wherein said spider slips are controlled remotely from said spider.

4. The apparatus of claim 1, wherein said pressure circuit controls pneumatic pressure to actuate said slips.

5. The apparatus of claim 1, wherein said pressure circuit controls hydraulic pressure to actuate said slips.

6. The apparatus of claim 1, wherein said pressure circuit supplies hydraulic pressure to actuate one set of slips, and supplies pneumatic pressure to actuate the other set of slips.

7. The apparatus of claim 1, wherein said pressure circuit comprises a plurality interconnected elevator valves, spider valves, and conduit systems.

8. The apparatus of claim 7, wherein said pressure to at least one elevator valve and one spider valve is supplied by a pilot valve.

* * * * *